United States Patent [19]

Spickard

[11] Patent Number: 4,684,087

[45] Date of Patent: Aug. 4, 1987

[54] GROCERY BAG HOLDER AND KIT FOR THE ASSEMBLY THEREOF

[76] Inventor: Gerald V. Spickard, 311 E. Northfield Blvd., Murfreesboro, Tenn. 37130

[21] Appl. No.: 897,587

[22] Filed: Aug. 18, 1986

Related U.S. Application Data

[63] Continuation-in-part of Ser. No. 841,554, Mar. 20, 1986, abandoned, which is a continuation-in-part of Ser. No. 763,336, Aug. 6, 1985, abandoned.

[51] Int. Cl.[4] ..... A63B 55/04

[52] U.S. Cl. ..... 248/97; 248/150; 224/42.42

[58] Field of Search ..... 248/95, 97–101, 248/150, 165, DIG. 7; 211/182; 403/349; 224/42.42

[56] References Cited

U.S. PATENT DOCUMENTS

| | | | |
|---|---|---|---|
| 765,388 | 7/1904 | Lanpher | 248/97 |
| 1,350,443 | 8/1920 | Edstrom | 248/97 |
| 1,500,964 | 7/1924 | Starks | 248/97 |
| 1,542,164 | 6/1925 | Nelson | 248/97 |
| 1,587,090 | 6/1926 | Tweed | 211/182 |
| 1,965,644 | 7/1934 | Heffelfinger | 403/349 |
| 2,931,517 | 4/1960 | Youngblood | 248/DIG. 7 |
| 3,423,781 | 1/1969 | Henson | 403/349 |
| 3,851,601 | 12/1974 | Davis | 211/182 |
| 4,157,801 | 6/1979 | Elmer | 248/101 |
| 4,174,085 | 11/1979 | Ferreira | 248/97 |
| 4,189,056 | 2/1980 | Majewski | 224/42.42 R |
| 4,226,348 | 10/1980 | Dottor | 224/42.42 R |
| 4,304,378 | 12/1981 | Briggs | 248/97 |
| 4,372,512 | 2/1983 | Wolfe | 224/42.42 R |
| 4,537,376 | 8/1985 | Buku | 248/97 |
| 4,540,213 | 9/1985 | Herlitz | 224/42.42 R |

*Primary Examiner*—J. Franklin Foss
*Assistant Examiner*—Robert A. Olson
*Attorney, Agent, or Firm*—E. Strickland

[57] ABSTRACT

A grocery bag holder is made up principally of at least partially tubular components which include rails, upper end cross members and corner supports as parts of a kit to be assembled by locking keys into keyways. Upper rails join the upper end cross members together in rectangular-like form. Lower rails join corner supports together, the far ends of the corner supports having keys which fit into keyways of the upper end cross members, the corner supports being L-shaped. Each corner support has a key at a smaller diameter end thereof and a keyway at a larger diameter end. Each rail has a key at each end thereof. Corner supports and upper end cross members are each of one piece. Rails may be of two parts which may be screwed or otherwise fastened together, or they may exist as separate pieces in the kit adapted to be put together when the whole grocery bag holder is assembled from kit parts.

10 Claims, 6 Drawing Figures

GROCERY BAG HOLDER AND KIT FOR THE ASSEMBLY THEREOF

BACKGROUND OF THE INVENTION

This is a continuation-in-part of Ser. No. 841,554, filed Mar. 20, 1986, which is in turn a continuation-in-part of Ser. No. 763,336, filed Aug. 6, 1985 now abandoned.

FIELD OF THE INVENTION

This invention relates to containers. More particularly, it relates to a grocery bag holder and a kit containing components for making same.

DESCRIPTION OF THE PRIOR ART

Various types of grocery bag holders are known, including those which may be folded up. However, none is presently known which can be assembled from parts and then disassembled so that it may be conveniently stored in a small area and made availabe by a supermarket to its customers for quick assembly for putting their filled shopping bags therein and holding them upright in their automobiles or trucks without breaking bottles or spilling groceries.

Summary of the Invention

After extended investigation I have developed a kit for making a grocery bag holder out of a limited number of at least partially tubular kit components all constructed so as to fit together in assembled form without use of fasteners by inserting keys, nubs or tabs into keyways, slots or grooves. The components of my kit and grocery bag holder made therefrom include only rails, upper end cross members and corner supports. Each rail has keys for fitting into corresponding keyways of the upper end cross members and if lower rails are employed, into corresponding keyways of the corner supports, and may be of one of two or more parts, preferably two, which may be screwed or otherwise fastened together without the use of fasteners.

Each cross member is of a sawed-off U shape and has a keyway at each end as well as a keyway in a portion or receptacle thereof directed perpendicular to the plane of the main part of the U for insertion therein of a matching key on one end of a corner support, the other end of which has a keyway for insertion therein of the corresponding key of a lower or bottom rail. Each corner support is of smaller diameter at its key end than at its keyway end. The cross members are integral pieces, as defined below, as are the corner supports and may be molded as such. By integral I mean single pieces, that is, with each being a single piece or component. The kit preferably has an extendible spring as a part or component thereof, for example, with means at each end thereof to hook it to or over the upper rails so as to hold one or more full shopping bags in place upright when a second or third is not available to take up the remaining space.

As will be clearer from the drawing and the description thereof which follows hereinafter, the components of the kit described hereinabove may conveniently be referred to as upper and lower rails, left-hand and right-hand corner supports which have lower left-hand and lower right-hand receptacles and upper end cross members which have upper left-hand and right-hand receptacles and receptacles which are perpendicular to the plane of the upper end cross members.

BRIEF DESCRIPTION OF THE DRAWING

For a better understanding of my invention reference will now be made to the drawing and the following description thereof which represent a preferred embodiment of the invention.

In the drawing.

DETAILED DESCRIPTION OF THE INVENTION

Figure 1:
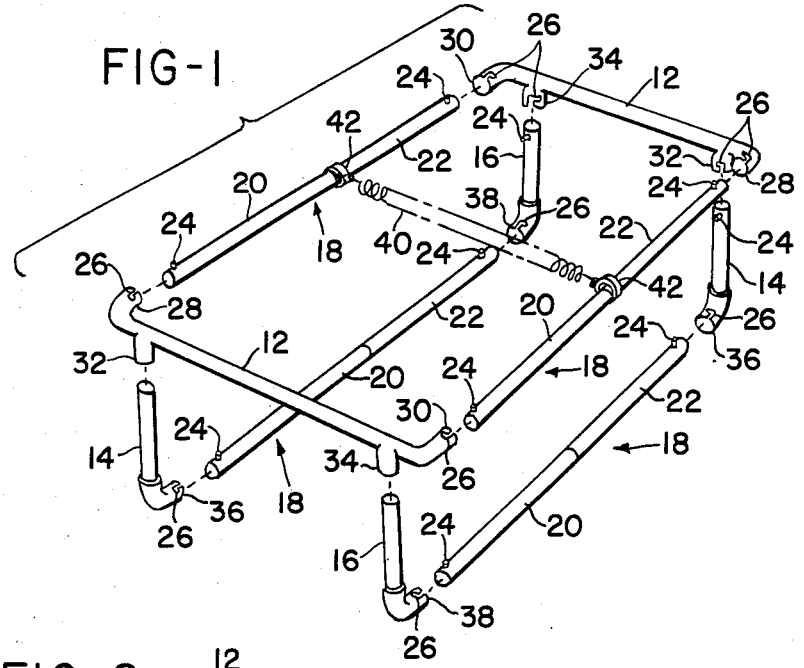
FIG. 1 shows in perspective the components of my kit in position to be assembled as a grocery bag holder.
Figure 3:
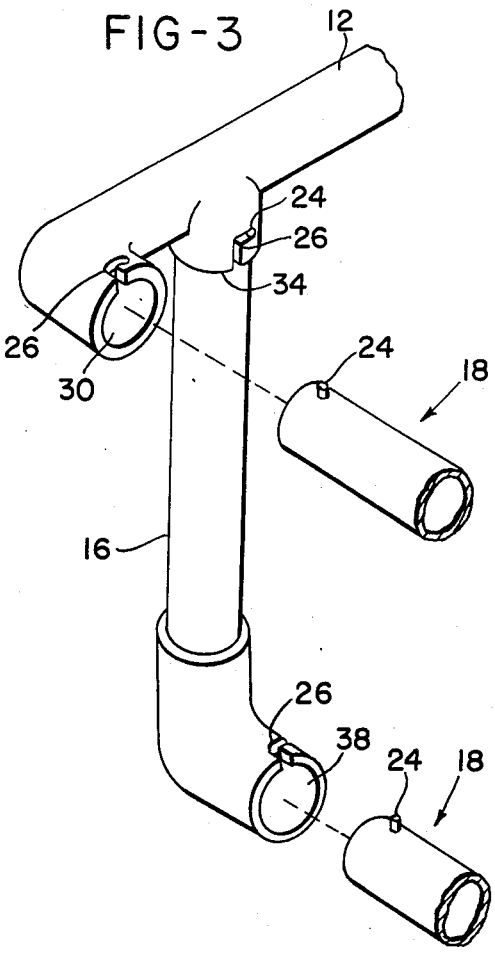
FIG. 3 is similar to FIG. 2 except for showing the one corner support with a key at one end locked into a keyway of the upper end cross member and the end of the lower rail lined up with the other end of the one corner support.
Figure 4:
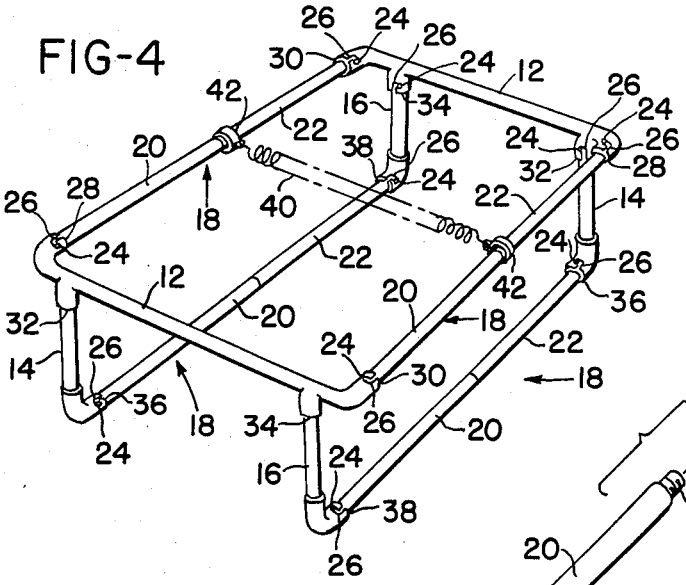
FIG. 4 depicts a grocery bag holder according to the invention with kit components such as shown in FIG. 1 assembled together.

Components of the kit and grocery bag holder of the invention, as shown particularly in FIGS. 1 and 4, include two left-hand corner supports 14 diagonally opposed in the completed grocery bag holder, two right-hand corner supports 16 diagonally opposed in the completed grocery bag holder, two upper and two lower rails 18, 18A each of which may be a single piece or of two or more parts such as 20 and 22, for example, adapted to be screwed together by external 44 and internal 46 threads (FIG. 5) and two upper end cross members 12 adapted to serve at opposite upper ends of the grocery bag holder. Each corner support 14, 16 and each upper end cross member is an integral, single piece member. The kit may also contain an extendible spring 40 having a connector 42, as illustrated in FIG. 6. Keys are shown as 24 and keyways as 26 in the various components of the kit of the invention. Rails 18 have keys 24 at each end thereof. Upper end cross members have four keyways 26 each, two near each end thereof, one for connection to a rail member and the other in a receptacle 32 (left-hand), 34 (right-hand) which is pointed in a plane perpendicular to that of the upper end cross members, for locking therein of a key 24 of a corner support 14, 16. Respective left-hand 14 and right-hand 16 corner supports have a keyway 26 at one end and a key 24 at another. As may be seen most clearly in FIGS. 2 and 3, respective left-hand and right-hand corner supports 14, 16 are each of a single piece and of a larger diameter at respective left-hand lower horizontal receptacle 36 and right-hand lower horizontal receptacle 38 ends than at opposite or key 24 ends (by bevelling or tapering).

Figure 2:
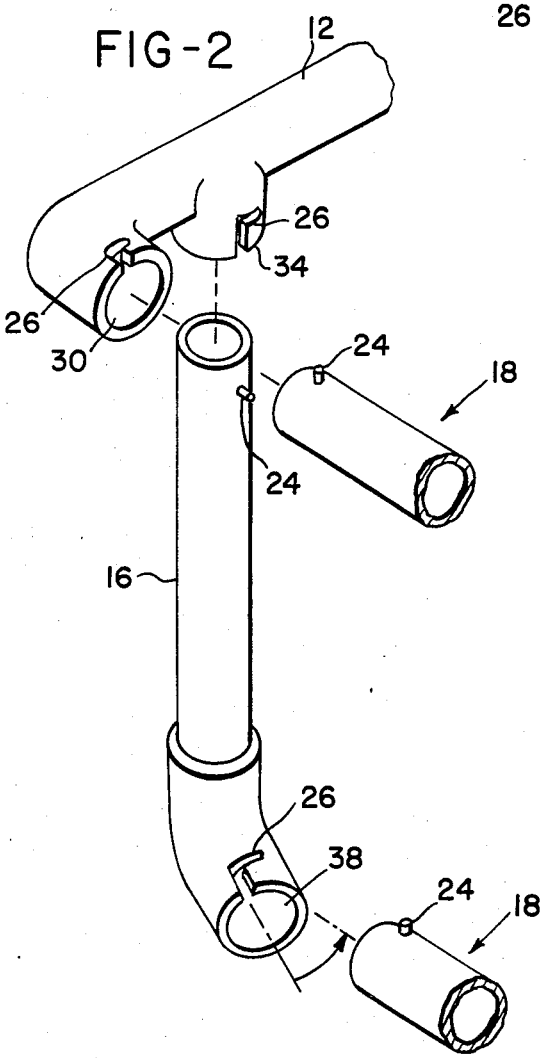
FIG. 2 is an enlargement in perspective depicting how keyway connecting portions of an upper end cross member, one end of an upper rail, one end of a lower rail and one of four corner supports are positioned ready for assembly together to form a corner of a grocery bag holder.

FIGS. 2 and 3 also show how key 24 of representative right-hand corner support 16, for example, is about 30° offset from the opposite end keyway 26 dotted center line so that it can be inserted and turned to lock in proper alignment in keyway 26 of end cross member 12. Corner supports are made left-hand 14 and right-hand 16 as are upper horizontal 28, 30 and upper vertical 32, 34 receptacles or receptacle portions of upper end cross members 12 so that keyways 26 point toward the center, that is, internally when kit components are assembled together as a grocery bag holder such as shown in FIG. 3.

Figure 5:
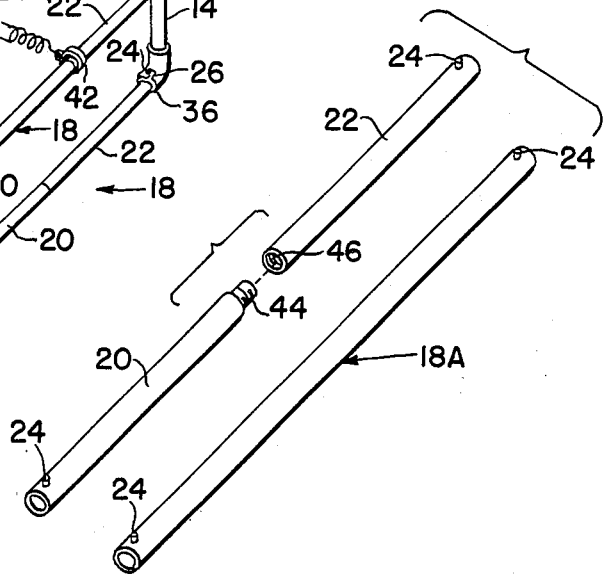
FIG. 5 is a perspective view of a rail component of the kit of the invention both as a single piece or component and as made of two sections which form two components of the kit instead of a single component or unitary rail, said two sections ready to be screwed together if not already screwed together before sale.
Figure 6:
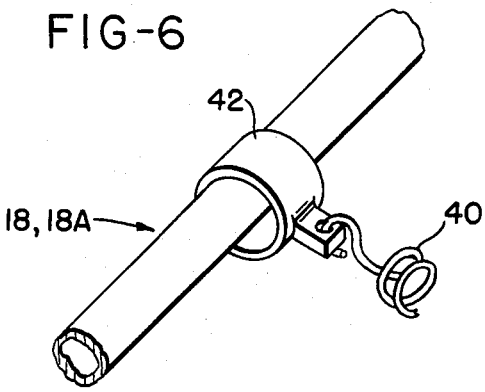
FIG. 6 is a perspective enlargement showing use of one end of a representative spring such as may be a part of the kit of the invention.

According to the embodiment of FIG. 5, sections 20, 22 may exist separately in the kit of the invention rather than having been already pre-assembled by screwing together via external 44 and internal 46 threads.

While the invention has been described in terms of preferred embodiments, the claims appended hereto are intended to encompass all embodiments which fall within the spirit of the invention.

Having thus described my invention and certain preferred embodiments thereof, I claim:

1. Components for assembly of a frame for receiving grocery bags without the use of separate fasteners, comprising two lower single piece rails, two upper single piece rails, four single piece corner members, and two single piece cross members, each cross member having integral right angle end poritons for connecting to the two upper rails, and two integral downwardly directed portions for connecting respectively to the four corner members, said downwardly facing portions being located inwardly of the right angle end portions, and the four corner members having integral right angle end portions for connecting to the ends of the lower rails, with the connections between the members comprising an end of one member including a key insertable into a hollow portion of the other member which includes a keyway, wherein the keys may be rotated relative to the keyways to connect the members together.

2. The components of claim 1 wherein said corner members comprise two left-hand corner members and two right-hand corner members.

3. The components of claim 1 wherein each of said corner members has two ends with a key at one and a keyway at the other, the key end being of smaller diameter than the keyway end.

4. The components of claim 3 wherein said key at one end is offset about 30° from a centerline of said keyway.

5. The components of claim 1 wherein each of said rails has a key at each end thereof.

6. The kit of claim 5 wherein each of said rails comprises two separate sections adapted to be screwed together, each having a key at one end thereof.

7. The grocery bag holder of claim 1 having as a non-structural component thereof a spring extending between said upper rails.

8. The grocery bag holder of claim 1 wherein a key on one end of each of said corner members is offset about 30° from a center line of a keyway on the other end of each of said corner members.

9. The grocery bag holder of claim 1 wherein said rails are of at least two sections joined together along their length.

10. A frame for receiving and holding grocery bags, the frame being assembled without the use of separated fasteners, and comprising two single piece lower rails, two single piece upper rails, four single piece corner members, and two single piece cross members, each cross member having integral right angle end portions connected to the upper rails, and two integral downwardly directed portions connected respectively to the four corner members, said downwardly facing portions being located inwardly of the right angle end portions, and the corner members having integral right angle end portions connected to the end of the lower rails, with the connections between the members comprising an end of one member including a key insertable into a hollow portion of the other member which includes a keyway, wherein the keys may be rotated relative to the keyways to connect the members together.

* * * * *